US010037858B2

(12) United States Patent
Välivainio et al.

(10) Patent No.: US 10,037,858 B2
(45) Date of Patent: Jul. 31, 2018

(54) ELECTRIC SWITCH ASSEMBLY

(71) Applicant: ABB OY, Helsinki (FI)

(72) Inventors: Mikko Välivainio, Vaasa (FI); Juha Soldan, Vaasa (FI); Jari Elomaa, Vaasa (FI)

(73) Assignee: ABB Oy, Helsinki (FI)

( * ) Notice: Subject to any disclaimer, the term of this patent is extended or adjusted under 35 U.S.C. 154(b) by 0 days.

(21) Appl. No.: 14/784,485

(22) PCT Filed: Apr. 15, 2013

(86) PCT No.: PCT/FI2013/050411
§ 371 (c)(1),
(2) Date: Oct. 14, 2015

(87) PCT Pub. No.: WO2014/170528
PCT Pub. Date: Oct. 23, 2014

(65) Prior Publication Data
US 2016/0099120 A1 Apr. 7, 2016

(51) Int. Cl.
*H01H 1/20* (2006.01)
*H01H 19/04* (2006.01)
(Continued)

(52) U.S. Cl.
CPC ..... *H01H 19/04* (2013.01); *H01H 1/2058* (2013.01); *H01H 1/365* (2013.01);
(Continued)

(58) Field of Classification Search
CPC ..... H01H 9/32; H01H 19/04; H01H 19/115; H01H 19/10; H01H 1/365; H01H 1/42;
(Continued)

(56) References Cited

U.S. PATENT DOCUMENTS 1,610,676 A * 12/1926 Hart ..... H01H 19/10 200/254
1,999,695 A * 4/1935 Jackson ..... H01H 9/32 200/300
(Continued)

FOREIGN PATENT DOCUMENTS

CN 1707720 A 12/2005
CN 101989501 A 3/2011
(Continued)

OTHER PUBLICATIONS

National Board of Patents and Registration of Finland, International Search Report issued in International Patent Application No. PCT/FI2013/050411 dated Jan. 29, 2014, 3 pp.
(Continued)

*Primary Examiner* — Felix O Figueroa
(74) *Attorney, Agent, or Firm* — Taft Stettinius & Hollister LLP; J. Bruce Schelkopf

(57) ABSTRACT

A rotary switch assembly, including a rotary contact and a stationary contact, and a rotary actuator for rotating the rotary contact such as to connect with and disconnect from the stationary contact. The rotary actuator includes a shield for shielding the rotary contact from a side that faces the stationary contact when the rotary contact and the stationary contacted are being disconnected from each other.

19 Claims, 7 Drawing Sheets

(51) Int. Cl.

| | |
|---|---|
| ***H01H 9/34*** | (2006.01) |
| ***H01H 9/32*** | (2006.01) |
| ***H01H 1/36*** | (2006.01) |
| ***H01H 1/42*** | (2006.01) |
| ***H01H 19/64*** | (2006.01) |
| ***H01H 11/04*** | (2006.01) |
| ***H01H 19/14*** | (2006.01) |
| *H01H 9/36* | (2006.01) |

(52) U.S. Cl.
CPC ..... *H01H 1/42* (2013.01); *H01H 9/32* (2013.01); *H01H 9/341* (2013.01); *H01H 11/04* (2013.01); *H01H 19/14* (2013.01); *H01H 19/64* (2013.01); *H01H 1/2041* (2013.01); *H01H 9/36* (2013.01); *H01H 2205/002* (2013.01); *H01H 2223/044* (2013.01)

(58) Field of Classification Search
CPC ..... H01H 1/2041; H01H 1/2058; H01H 9/34; H01H 9/341
USPC ..... 200/570
See application file for complete search history.

(56) References Cited

U.S. PATENT DOCUMENTS

| | | | | | |
|---|---|---|---|---|---|
| 2,912,528 | A * | 11/1959 | Wall | H01H 9/0066 | 200/18 |
| 3,050,604 | A * | 8/1962 | Kusche | H01H 19/623 | 200/286 |
| 3,202,775 | A | 8/1965 | Tillson | | |
| 3,959,616 | A | 5/1976 | Swanson et al. | | |
| 4,914,262 | A * | 4/1990 | Appleton | H01H 21/18 | 200/19.11 |
| 5,151,565 | A * | 9/1992 | Perret | H01H 1/365 | 218/57 |
| 5,319,167 | A * | 6/1994 | Juds | H01H 1/365 | 218/1 |

FOREIGN PATENT DOCUMENTS

| | | | | |
|---|---|---|---|---|
| EP | 0059475 | A2 | 9/1982 | |
| EP | 0061020 | A1 | 9/1982 | |
| EP | 0788128 | A2 | 8/1997 | |
| EP | 1605483 | A1 | 12/2005 | |
| EP | 2866242 | A1 * | 4/2015 | H01H 1/365 |
| GB | 887369 | A | 1/1962 | |

OTHER PUBLICATIONS

Search Report and Written Opinion, European Patent Application No. 13882405.7, dated Dec. 6, 2016, 5 pages.

* cited by examiner

ELECTRIC SWITCH ASSEMBLY

FIELD

The present invention relates to an electric switch, especially to a contact assembly of the electric switch.

BACKGROUND

An arc emerges when the contacts of an electric switch are disconnected from each other. Gas produced by the arc is to be exhausted from the housing.

Regarding the gas, the focus has mainly been in removing the gas as effectively from the housing as possible, without taking any advantage of the gas formed in the housing.

SUMMARY

An object of the present invention is to provide a switch so as to alleviate the above disadvantages. The object is achieved by the invention which is defined by the independent claims. Some embodiments are disclosed in the dependent claims.

DRAWINGS

In the following, the invention will be described in greater detail by means of some embodiments with reference to the accompanying drawings, in which FIG. 1 shows an embodiment of an electrical device module;

DETAILED DESCRIPTION

Figure 1:
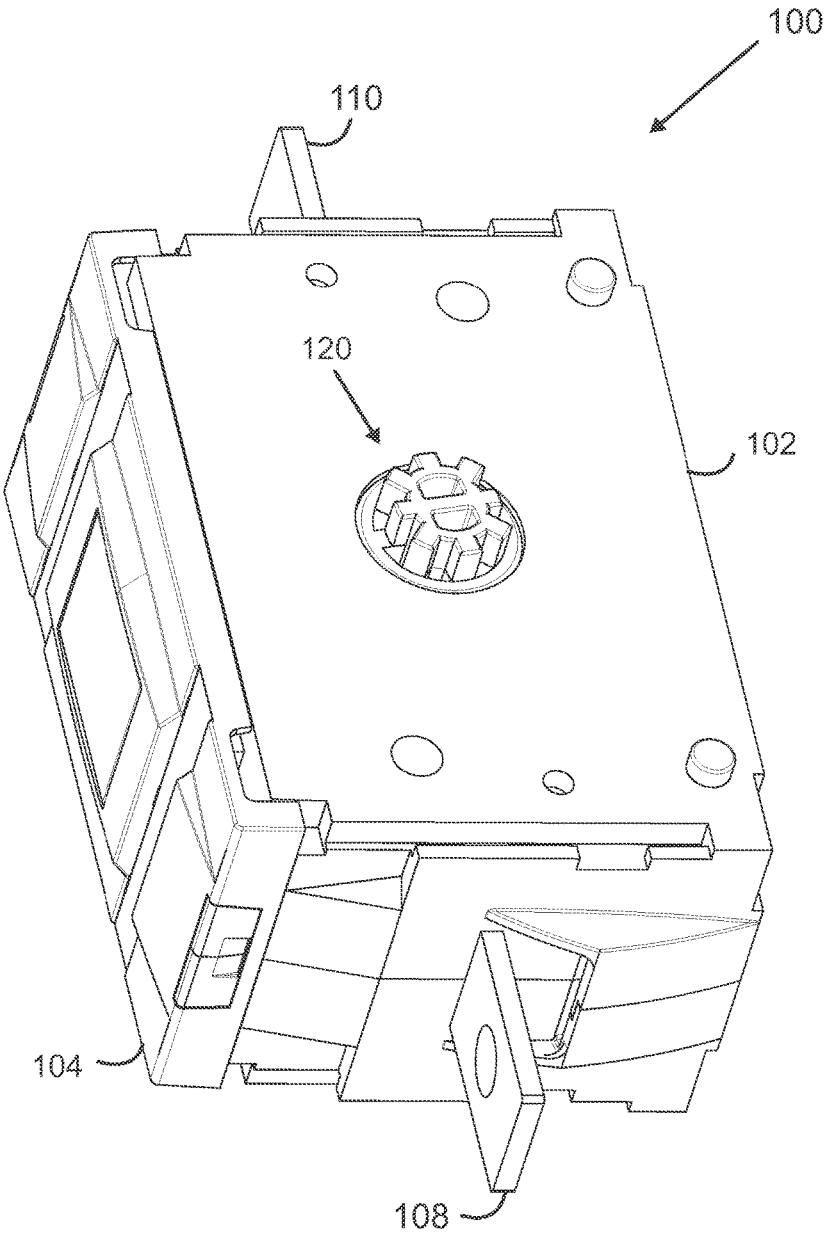

FIG. 1 shows an embodiment of an electric device module 100. The device may be an electric switch or breaker, for instance. The shown module may be mountable to another module. There is shown a rotary actuator 120, In FIG. 1, the visible part of the rotary actuator is of a male type, which is mountable to a female actuator of an adjacent module.

The housing comprises two halves 102, 104, which are mountable to each other such as to form a module. There are provided stationary contacts 108, 110 at the ends of the module 100. The stationary contacts are provided for connecting the module to external conductors.

Within the module, there is a movable contact, which is a rotary contact in the example of FIG. 1. The movable contact may act as a contact bridge between the stationary contacts and may thus be applied to connect and disconnect the stationary contacts 108 and 110 electrically to/from each other.

Figure 2:
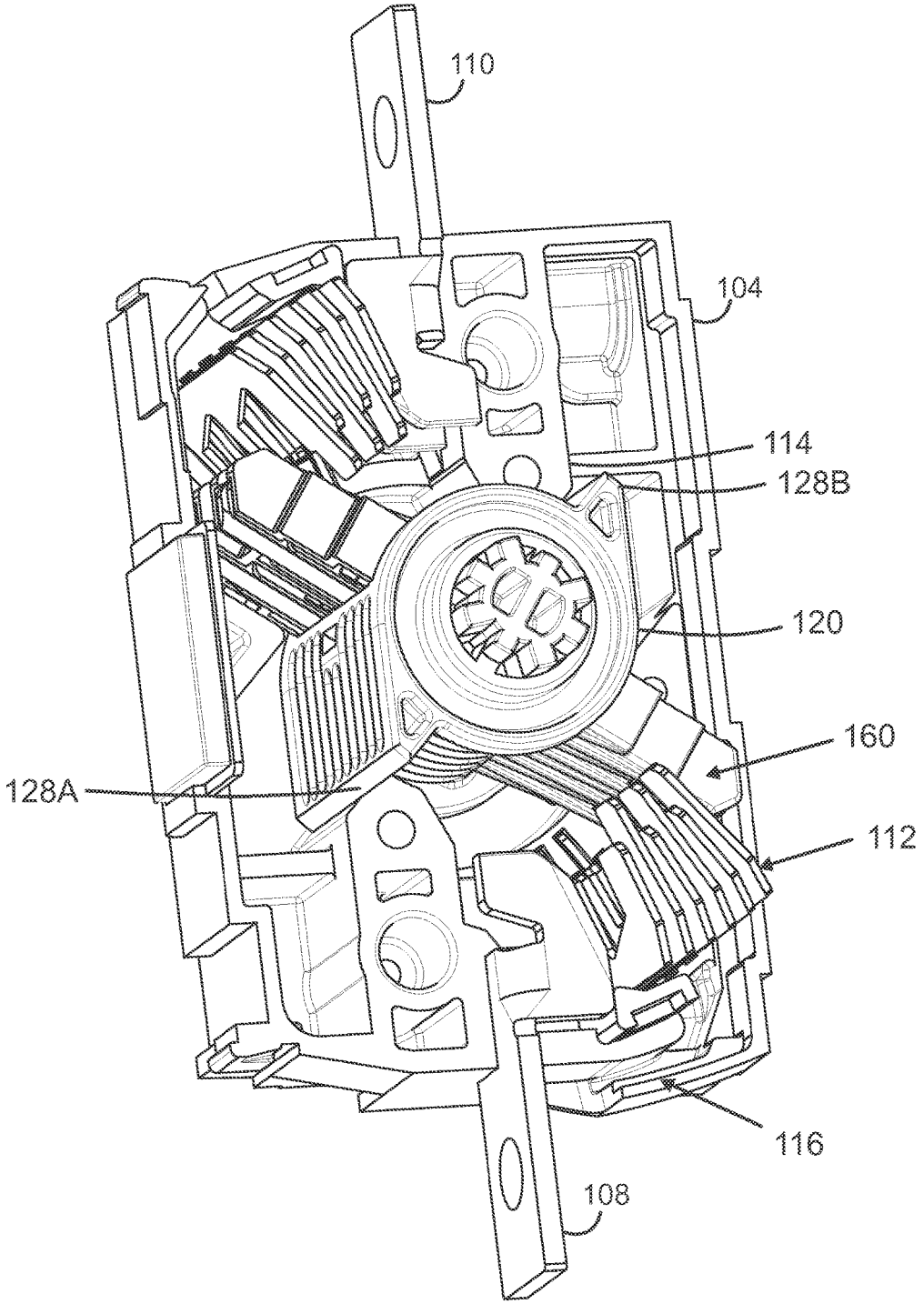
FIG. 2 shows a view of the interior of the module.

FIG. 2 shows an embodiment of a switch module opened such that the top half 102 of the module 100 has been removed for illustration purposes. There is shown a contact blade arrangement 160, which is rotatable by the rotary actuator 120. The contact blade arrangement comprises one or more contact blades, which may extend through the actuator residing in the middle of the module housing 104. The contact blades may be elongate conductive bars, and they may be inserted to the rotary actuator such that the longitudinal middle of the bars sets to the rotation axis of the actuator.

In FIG. 2, the module is shown in disconnected state where the contact portions residing at the ends of the contact blades are disconnected from the stationary contacts 108, 110. When connecting the stationary contacts by the rotary contact, the actuator is turned about 60 degrees clockwise.

The rotary actuator 120 may comprise stoppage members 128A, 128B, which may operate with stoppage elements of the housing. The rotary actuator may be opened with high speed by using spring arrangements (not shown), whereby the housing and/or the actuator provides means for ensuring safe stopping of the rapid rotation of the actuator. There is shown a stoppage element 114, which is arranged to receive the stoppage member 128B. There is a similar arrangement on the opposite side of the actuator.

There is also shown an arc chamber 112 for extinguishing an arc emerging from disconnecting the movable and stationary contacts from each other. The arc chamber may comprise a plurality of arc plates arranged towards the opening direction of the movable contact.

When an arc emerges at the disconnection, gas is generated. The housing is provided with a gas exhaust channel 116 for exhausting the gas and thus preventing the increased pressure to break the housing and/or the components therein.

Figure 3:
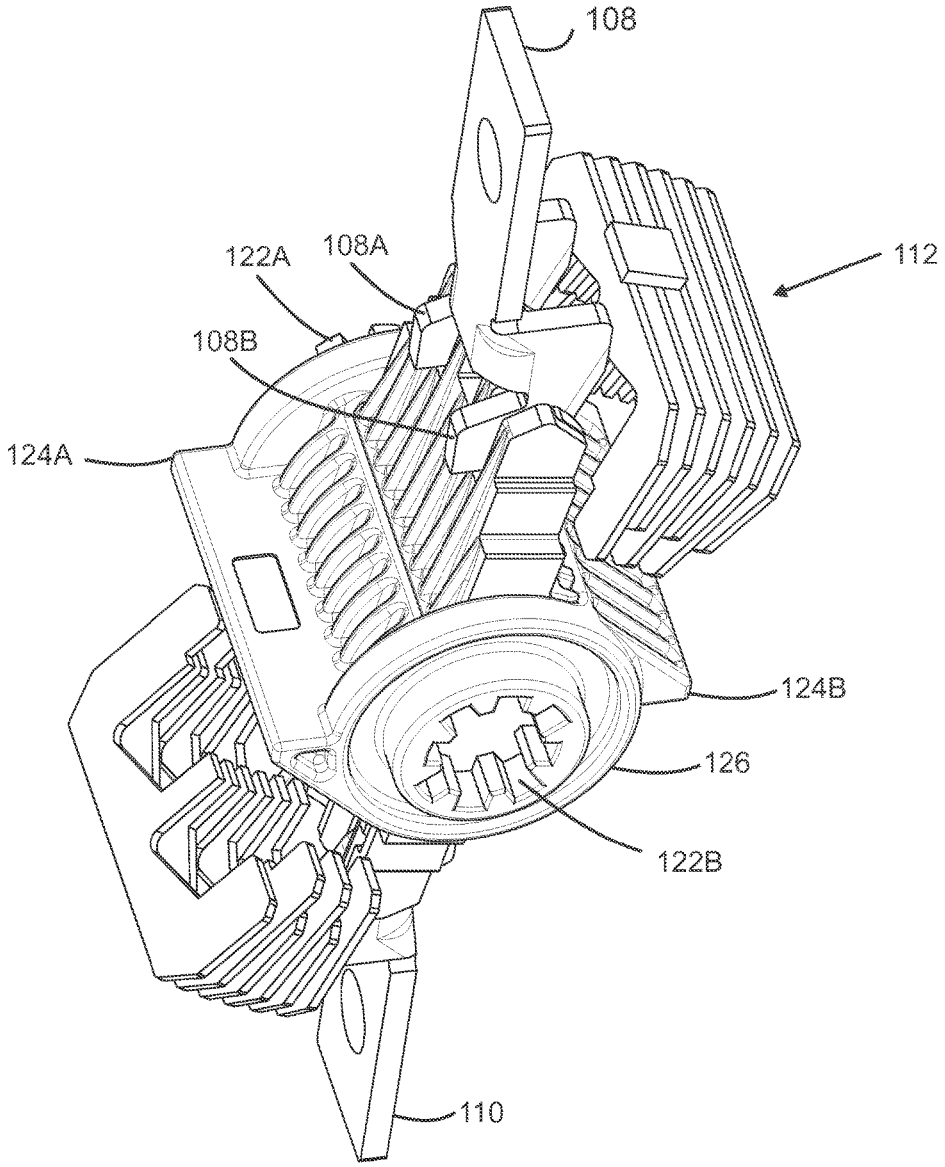
FIG. 3 shows a view of a rotary actuator.

FIG. 3 shows another view of the rotary actuator and the adjacent components of the module. Specifically, it is shown that the stationary contact 108 comprises two contact portions 108A and 108B. The rotary actuator is provided with two pairs of rotary contact blades, rotated simultaneously, and each pair contacting one of the contact portions of the stationary contact. There is thus one pair of contact blades arranged such that the contact portion 108A of the stationary contact is received between the contact blades, and another pair of contact blades arranged such that the contact portion 108B of the stationary contact 108 is receivable between the contact blades. The arrangement may be similar at both ends of the elongate contact blades.

Figure 4A:
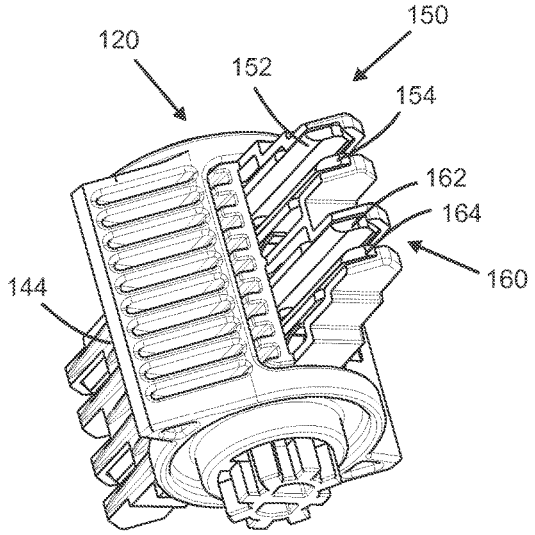
FIGS. 4A to 4D show views of a rotary actuator having contact blades mounted thereto.
Figure 4B:
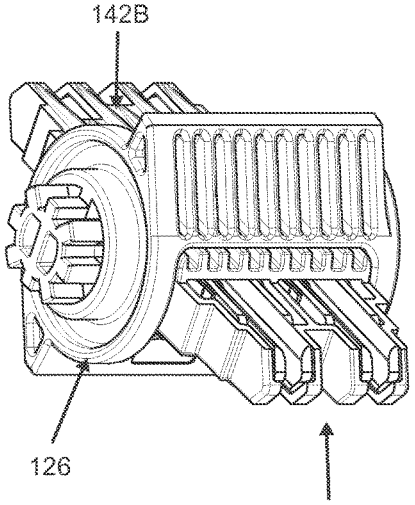
Figure 4C:
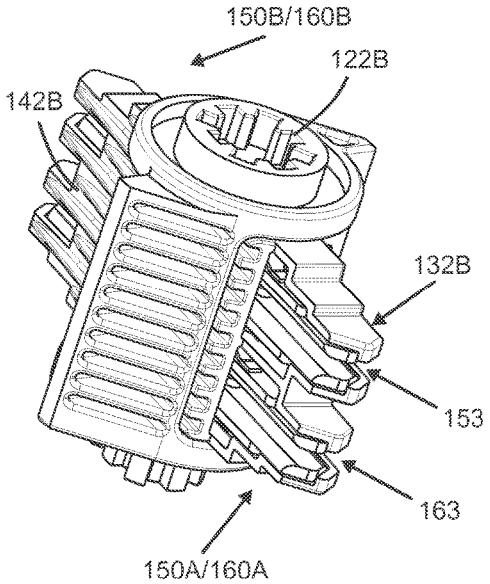
Figure 4D:
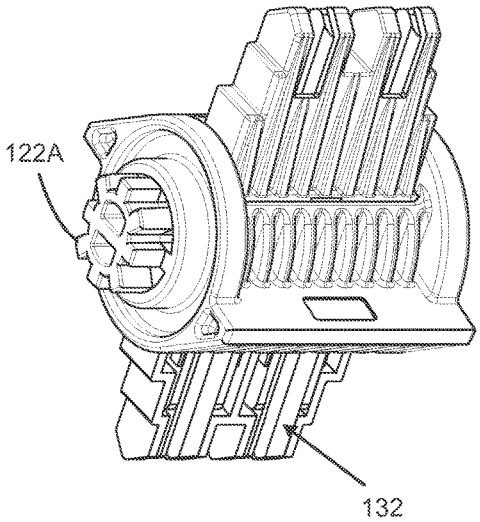

FIGS. 4A to 4C show the rotary actuator 120 to which the contact blades have been mounted to. The number of contact blades in the shown embodiment is four, but there may be another number of blades, too. In the shown embodiment, the contact blades are arranged to two pairs of contact blades, each arranged for receiving a stationary contact between the blades. The first pair of contact blades 150 comprises the blades 152 and 154, and the second pair 160 comprises the blades 162 and 164. The contact blades connect the first stationary contact at the first end 150A/160A of the blades, and the second stationary contact at the second end 150B/160B of the blades.

The actuator 120 comprises a substantially cylindrical body portion 126. The contact blades are inserted through the cylindrical body such that the longitudinal middle of the blades resides within the cylinder, and end portions of the contact blades remain outside of the cylinder. The portions of the contact blades that remain outside the cylinder may be equally long on both sides of the actuator 120.

The actuator may comprise stoppage members as explained in connection with FIG. 2. The actuator may also comprise a male rotary connector 122A and a female rotary connector 122B at opposite ends of the cylindrical body portion for connecting the actuator to corresponding mating connectors of adjacent switch and/or rotation mechanism modules.

The rotary may also comprise one or two contact shields, which will also be discussed in connection with subsequent figures. The task of the shields is to shield/cover the movable contact blades at least from the side that faces the contact portion of the stationary contact when the contacts are disconnected from each other. Thus, the shield shields the contact blades from the side that follows the rotary contact blades when the rotary contact is being disconnected from the respective stationary contact. Inversely, when the rotary contact approaches the stationary contact when the contact is being made, the shield precedes the rotary contact. Due to the shield, the gas emerging from the arc collides with the shield and adds to the rotation force of the actuator thus speeding up the opening of the contacts. Furthermore, the existence of the shield increases the pressure within the housing at disconnection, and thus urges the gases to the gas outlets of the housing.

The shields are arranged such they are on opposite sides of the contact blades on opposite sides of the actuator. In FIG. 4B, on the left side of the cylindrical middle portion 126, the shield 142B is arranged such that it covers the contact blades from the top. On the opposite end of the contact blades, that is, on the right side of the cylindrical middle portion 126, there is provided a shield 132B that faces the bottom side of the contact blades. In this way, when seen from the end of the male connector 122A, the counter-clockwise rotation leading to opening of the contacts is speeded up by both shields 132B and 142B.

Figure 5A:
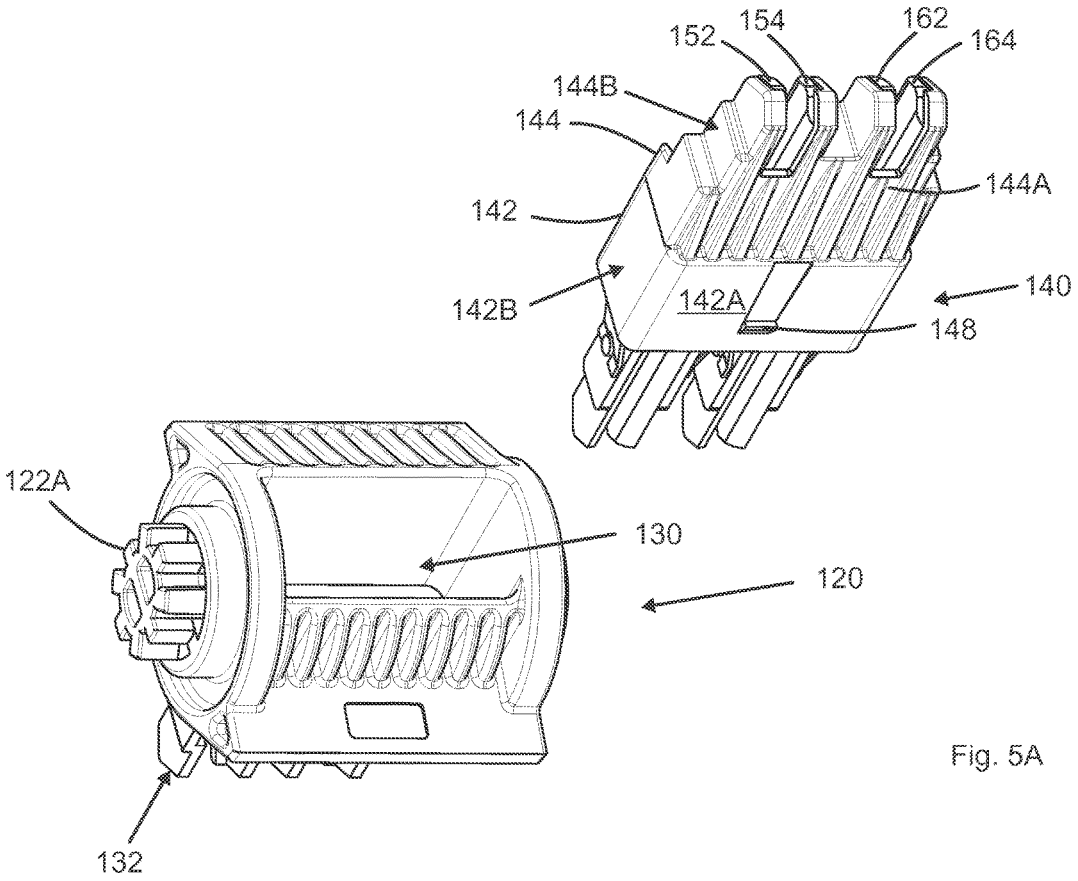
FIG. 5A shows a view of a rotary actuator and a contact shield before mounting them together.
Figure 5B:
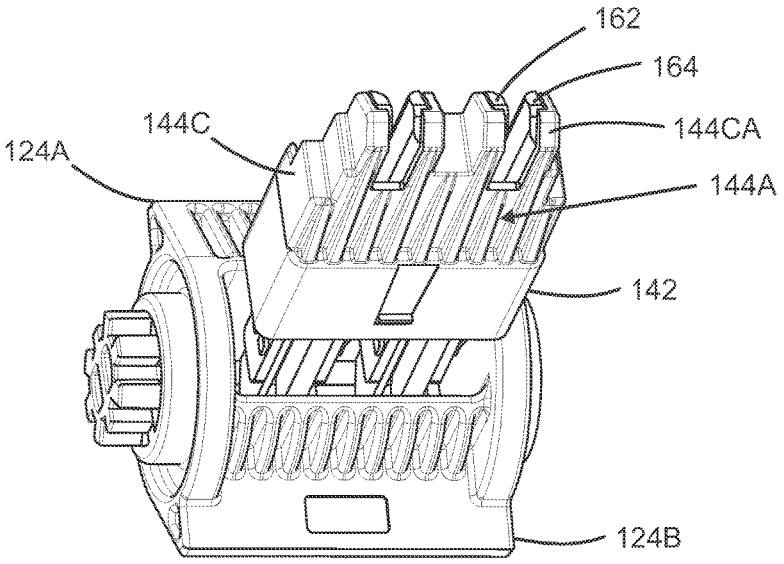
FIG. 5B shows a view of a rotary actuator and a contact shield during mounting them together.

FIGS. 5A and 5B illustrate the rotary actuator 120 and the rotary contact blades and the mutual assembly of them to each other.

As shown, there is provided an actuator 120, which is preferably made of electrically insulating material. The actuator is preferably unitary made by moulding of plastic, for instance.

There is additionally provided a separate contact shield 140, which can be inserted to the actuator 120. The shield is fixed/arranged to the actuator such that it follows the rotation of the actuator.

The mounting order is such that the contact blades may be first inserted to the contact shield as shown in FIG. 5A, where after the contact shield 140 carrying the contact blades is inserted to the actuator 120 as shown in FIG. 5B. When the contact blades are inserted to the contact shield 140, the contact blades set such that approximately the longitudinal middle of the contact blades sets to the end of the contact shield, which is inserted to the actuator. In the other end of the contact blades, the contact shield may extend substantially to the end of the contact blades. Thereby, the shield 140 is at least partly arranged to shield, in longitudinal direction, one half of the contact blades.

For inserting the contact shield to the actuator, the actuator 120 comprises a receptacle 130 for receiving the contact shield. The contact shield 140 comprises a mounting portion 142 for inserting to the receptacle 130 of the actuator. The receptacle and the mounting portion may be substantially rectangular, for instance.

The depth of the mounting portion 142 may be such that the mounting portion fits to the receptacle. The inner walls of the receptacle thus support the mounting portion from all sides and from the end. The mounting portion may be such that it has an open interior between the edge walls such that the contact blades can be inserted through the mounting portion.

The mounting portion comprises a bottom wall 142A, and a side wall 142B extending from an end of the bottom wall and perpendicular to the bottom wall. On the other end of the bottom wall of the mounting portion there is provided another side wall opposite to the side wall 142B, and a top wall opposite to the bottom wall 142A. The bottom wall 142A may be provided with a locking member 148 for locking the contact shield 140 to the actuator. The locking means may comprise a protrusion or a receptacle. The actuator may comprise on an inner wall of the aperture 130 a locking member, which co-operates with the locking member 148 of the contact shield. That is, if the contact shield comprises a protrusion, the actuator comprises a receptacle for receiving the protrusion, or vice versa.

In addition to the mounting portion 142, the contact shield 140 comprises a shielding portion 144. The shielding portion 144 may be unitary with the mounting portion 142 and they may be of the same piece made by moulding, for instance. Preferably the contact shield 140 is made of electrically insulating material, which may be the same material which the actuator 120 is made of. When the contact shield 140 is mounted to the actuator the shielding portion 144 sets outside the actuator 120.

The shielding portion 144 may comprise a bottom wall 144A for shielding the contact blades from the bottom direction. The bottom wall 144A serves for the purpose of receiving the gases emerged from the burning arc when the rotary contact blades are disconnected from the stationary contacts. The gases thereby push the bottom wall 144A, which accelerates the rotation of the actuator when the contact is being opened.

The bottom wall 144A comprises portions, which at least substantially shield the contact blades from the bottom direction. In the contact area between the contact blades of each contact blade pair, the bottom wall 144A may have a cut-out or an indentation, which allows the reception of a contact portion of a stationary contact between the contact blades. The shield thus comprises fingers, which extend to the end of the contact blades thus covering the blades from the bottom. The spaces between the fingers are also covered, except at the area of the contact portions of the contact blades.

The shielding portion may also comprise a plurality of side walls 144B, which cover and protect the contact blades from the side. Side walls may be provided at both ultimate sides of the contact shield. Such side walls thus cover the outermost contact blades 152 and 164 from the outer sides. The two other contact blades 154 and 162 may be covered from the middle sides. That is, there are no protective walls between the contact blades of each pair of blades 152, 154, and 162, 164. But the contact blade 154 has a covering wall on that side of the blade that faces the blade 162, and the blade 162 has a covering wall on the side that faces the blade 154.

FIG. 5A shows also part of a second contact shield 132, which is more thoroughly discussed in connection with FIG. 6. The purpose of the second contact shield 132 is the same as the purpose of the discussed contact shield 142. It is noted, that due to the rotation of the actuator, the second contact shield 132 shields the opposite surface of the contact blades than the first contact shield 142.

Figure 6:
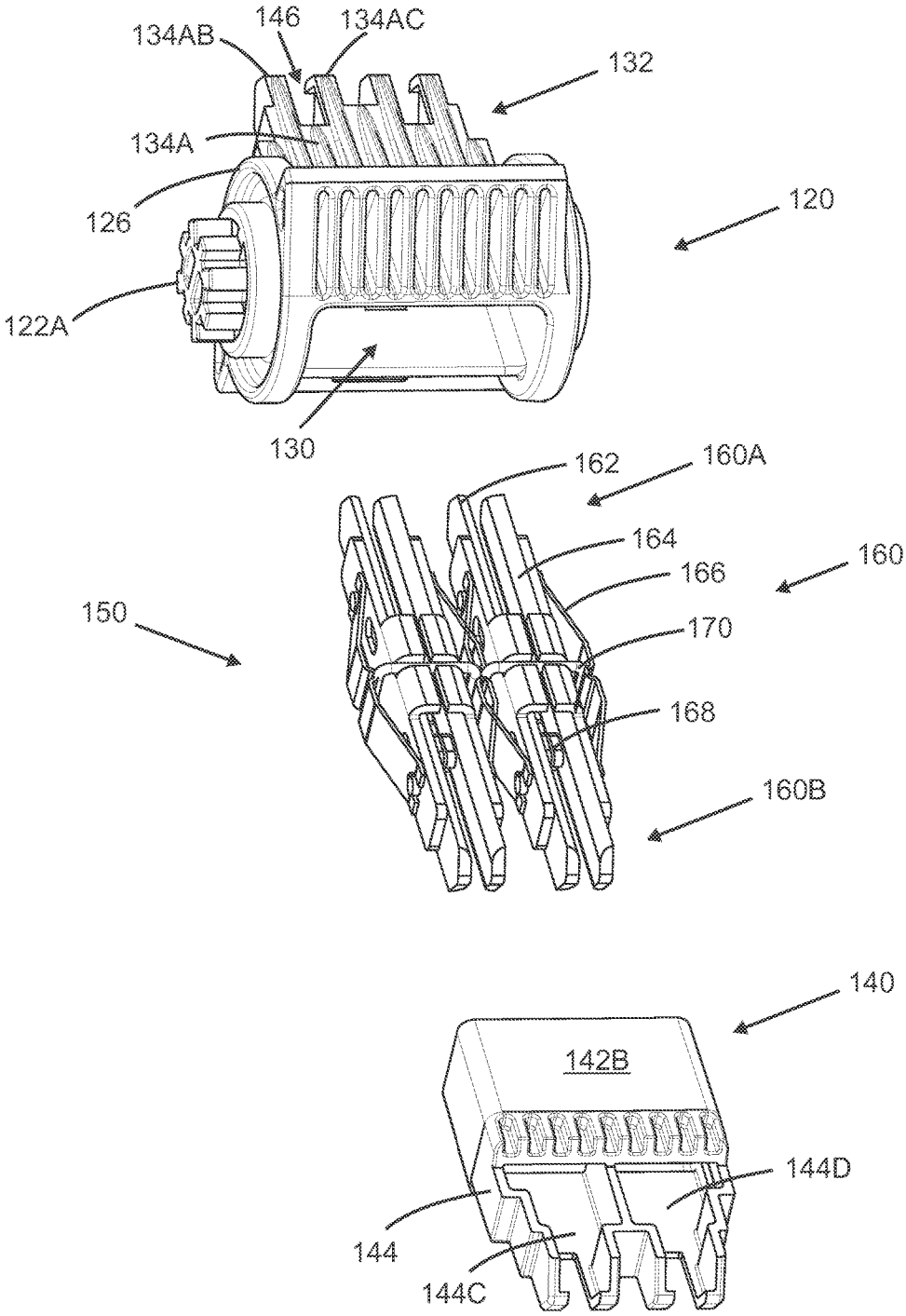
FIG. 6 shows a view where the rotary actuator, the contact blades and the contact shield have been illustrate separately.

FIG. 6 shows another breakout view. As distinct elements are shown the actuator 120, two pairs of contact blades 150 and 160, and the contact shield 140.

The actuator 120 shown in FIG. 6 may be a unitary piece, that is, the parts of the actuator cannot be separated with breaking the structure of the actuator. The actuator comprises as in integral part a contact shield 130 for shielding the contact blades in a similar manner as the shield 140 explained in connection with FIGS. 5A and 5B. The difference here is that the shield 130 is an integral part of the actuator contrary to the shield 140, which is insertable to the actuator as a separate piece. The structures of the shields 130 and 140 may otherwise be substantially similar, at least regarding the portions of the shields that set outside the cylindrical portion of the actuator.

FIG. 6 shows two pairs 150, 160 of contact blades. Each pair of contact blades comprises two contact blades arranged at a distance from each other for receiving a stationary contact between the blades. There is a plurality of alternatives for the structure of the contact blades and FIG. 6 shows one example. In this example, the contact blades 162 and 164 are kept at a distance from each other by means of studs 168 that have been punched to both contact blades. There are springs 166 arranged to both outer surfaces of the contact blades 162, 164, which springs provide the attraction force between the contact blades, both in the situation when the stationary contact is between the contact blades and when the contact blades have been disconnected from the stationary contact. Each of the springs may have groove for receiving a hook 170, which keeps the whole assembly of the blades and springs together.

In the shown embodiment, the hook resides in the longitudinal middle of the contact blades 162, 164. The shield 140 may be dimensioned such that the open end of the shield that is inserted to the actuator extends substantially up to the hook. That is, the shield 140 is arranged to cover one half of the longitudinal length of the contact blades.

FIG. 6 also shows a contact shield 140 from the top side 142B. This is thus the side that is opposite to the bottom side 142A shown in FIGS. 5A and 5B. As can be seen, the shielding portion 144 of the contact shield 140 comprises two compartments 144C and 144D each receiving one pair of contact blades.

When mounting the parts of FIG. 6 to each other, this may be done in the following order. When the pairs of contact blades have been assembled, these pairs are inserted to the contact shield 140 from the rectangular end. The contact blades are pushed so far that they enter the compartments 144C and 144D, and eventually the ends of the contact blades stop to the respective wall sections at the end of the contact shield 140.

After the contact blades have been assembled to the contact shield 140, that assembly is inserted to the aperture 130 of the actuator 120. The ends 160A of the contact blades are pushed through the actuator 120 so far that the ends 160A of the contact blades meet the ends 134AB, 134AC of the second contact shield 130.

FIG. 6 also shows an indentation 146 or cut-out in the wall of the shield 134A. This cut-out is provided for receiving the stationary contact between the contact blades, which are shielded by the fingers 134AB and 134AC.

When mounted in the above disclosed way, the contact blades are being shielded from one side on one side of the actuator, and from the opposite side on the other side of the actuator. That is, on one side of the cylindrical portion, the contact blades are shielded from the top, and on the other side, the contact blades are shielded from the bottom. The top side refers here to the side of the contact blades that is on the top in FIG. 6.

FIG. 6 shows that one of the contact shields is integral with the actuator, and the other contact shield is removably attachable to the actuator. In another embodiment, both contact shields are removably attachable to the actuator.

Figure 7:
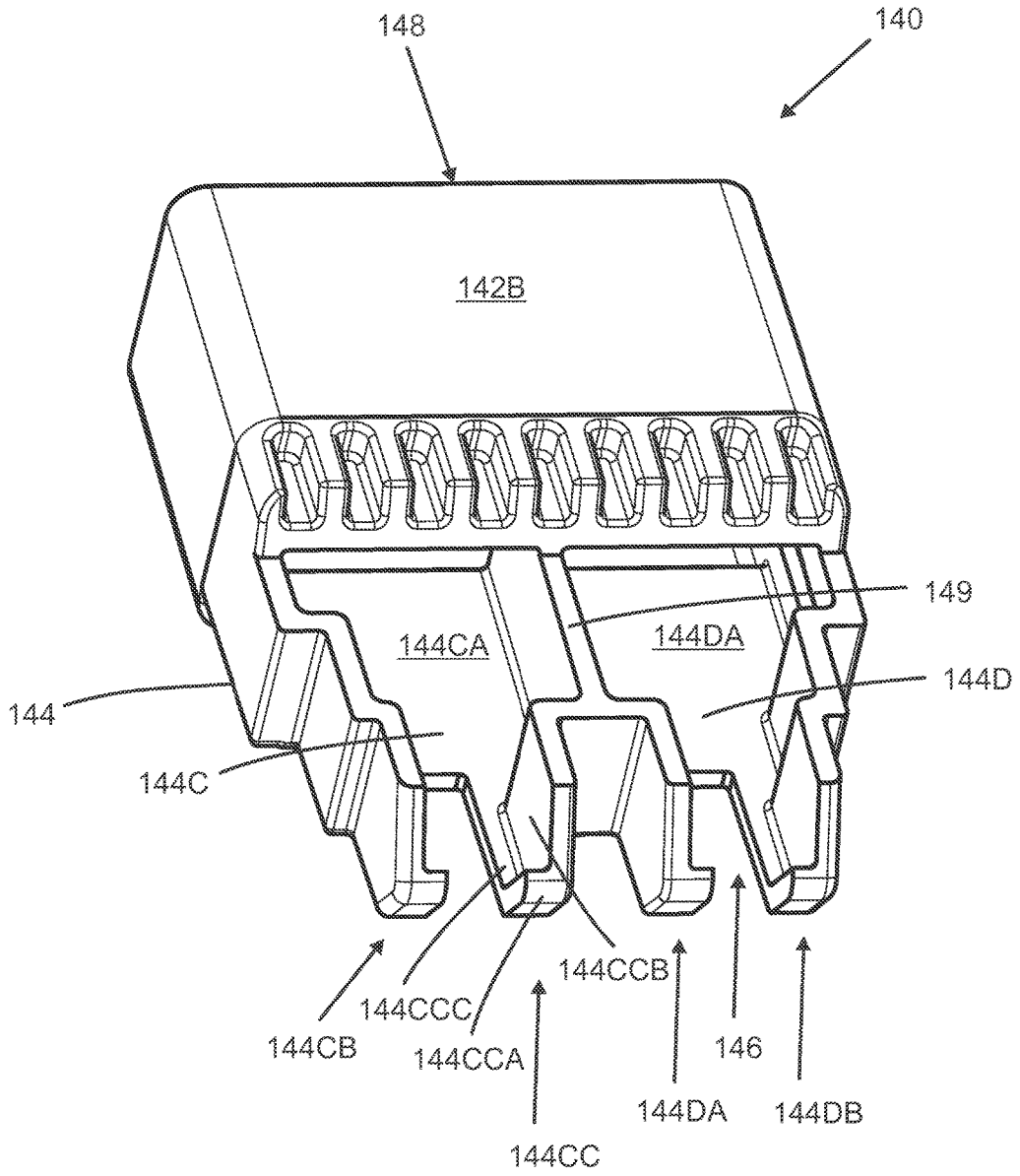
FIG. 7 shows a view of a contact shield.

FIG. 7 shows a closer view of the contact shield 140 of FIG. 6. It is noted the other contact shield may be substantially similar, whether or not it is integral with the body of the actuator. At least the shielding portions 132 and 142 of an integral and a distinct contact shield, which reside outside of the cylindrical body of the actuator, may be mutually similar.

The shielding portion of the contact shield comprises two compartments 144C, 144D each configured to receive and house a pair of contact blades. The compartments may be separated by a separation wall 149.

The bottom walls 144CA and 144DA of the compartments are the opposite faces of the bottom wall 144A of the shield. The compartment 144C also comprises a first finger 144CB for shielding a first contact blade, and a second finger 144CC for shielding a second contact blade. The fingers are provided for shielding the contact blades about the contact portion of the contact blade, where the contact blades make contact to the stationary contact.

The second finger 144CC comprises a bottom wall 144CCC for shielding the contact blade from the bottom together with the bottom wall 144CA of the compartment. The bottom wall 144CCC shields the finger at the area of the contact portion of the contact blade, which is the portion which makes contact to the stationary contact. The finger comprises also an end wall 144CCA, which is substantially perpendicular to the bottom wall of the finger 144CCC. The end wall is configured to set against the end of the contact blade. The finger may also comprise a side wall 144CCB, which shields the contact blade from the outer side. The outer side refers here to a wall, which is opposite to the side of the contact blade that makes the contact to the stationary contact.

In the following, some of the features discussed above will be summarized.

There is provided a rotary switch assembly, comprising a rotary contact and a stationary contact, and a rotary actuator for rotating the rotary contact such as to connect with and disconnect from the stationary contact, which rotary actuator comprises a shield for shielding the rotary contact from a side that faces the stationary contact when the rotary contact and the stationary contacted are disconnected from each other.

The shield is arranged to shield the rotary contact from the actuator to a longitudinal end of the rotary contact. That is, the shield may extend substantially perpendicularly from the actuator, and may at least partially shield the rotary contact blades to the end. If the contact blade extends through the actuator, the shield is arranged to protect the contact blade on one side of the actuator.

In an embodiment, the shield is arranged to shield the rotary contact completely from the side facing the stationary contact between the actuator and a contact portion of the rotary contact, which contact portion is arranged to make contact to the stationary contact. That is, until the contact portion, the contact blade is shielded from the side that faces the stationary contact when the contact is open. At the area of the contact portion of the rotary contact, the shield may shield approximately half of the thickness of the contact blade, for instance. This is due to that the making of the contact between the rotary contact and the stationary contact is not impeded. The part of the thickness, which is covered, is on the outer sides of the contact blades.

In an embodiment, the shield is formed as an integral part of a unitary actuator. The actuator may be a single casting piece, and the shield is part of the casting piece.

In another embodiment, the shield is removably attachable to the actuator. In both cases, whether being integral with the actuator or a removable shield, the shield is arranged to follow the rotation of the actuator, that is the shield(s) rotate with the actuator.

In an embodiment, the rotary actuator comprises a first shield on one side of the actuator, and a second shield on the opposite side of the actuator. Preferably, one of the shields is unitary with the actuator, and the other one is removable attachable. This provides advantages. On the side having the casting shield, the shield is maximally stiffly arranged to the actuator. On the other hand, when the shield on the other side is removable mountable, the mounting of the actuator is simple. This is in contrast to a situation where both sides would have fixed shields the mounting of the contacts to the actuator might be difficult.

In an embodiment, the first shield and the second shield residing on opposite sides of the actuator are arranged to shield opposite sides of the rotary contact. In this way the pushing effect of the arc gas is doubled, as the rotation of the actuator is accelerated on both sides of the actuator.

In an embodiment, the rotary actuator comprises a body portion for receiving the rotary contact through the body portion such that portions of the rotary contact reside outside and on opposite sides of the body portion when the rotary contact is mounted to the rotary actuator. In an embodiment, the rotary actuator comprises a substantially cylindrical body portion, and the shield extends from the cylindrical body portion.

In an embodiment, the actuator comprises a receptacle for receiving the shield for shielding the rotary contact. The receptacle, and the corresponding mounting portion of the shield may have a rectangular shape, for instance.

In an embodiment, the rotary actuator is arranged to house one or more pairs of contact blades, and the shield comprises a compartment for each pair of contact blades, the compartment arranged to shield the pair of contact blades also from the outer sides.

In the embodiments, the shield is fixed to the rotary actuator such that is follows the rotation of the actuator.

In an aspect, there is provided a shield for an electric switch, comprising an interior space for receiving at least a portion of a contact blade, the shield further comprises a mounting portion for mounting the shield to a rotary switch actuator, and a shielding portion for shielding a contact blade receivable at least partly interior of the shield. The shield is made of electrically insulating material.

When mounting the rotary contact assembly, the method comprises inserting a rotary contact to a shield made of insulating material, which shield is arranged to shield at least a portion of the rotary contact at least from one side, and inserting the shield, to which the rotary contact has been inserted, to a rotary actuator arranged to rotate the rotary contact.

The contact assembly may comprise one or more contact blades. Preferably the contact blades are arranged as pairs such that the stationary contact is received between the blades. The contact blades operate as contact bridges between the stationary contacts.

The contact blades are rotated by a rotary actuator. In the shown embodiment, the contact blades are elongate bars, which are inserted through the actuator such that the longitudinal middle of the contact bars sets to the rotation axis of the rotary actuator.

The shields serve for two purposes. On the other hand, they protect the contact blades from erosive effects of the arc.

The second advantage takes use of the gases that are formed by the burning arc. The gases cause the pressure to increase, which increase of the pressure is utilized in speeding up the opening of the switch contacts. The wall sections of the shields increase the area that is going to receive the pressure of the gas, whereby the rotation of the rotary contact towards the opening direction is accelerated.

Because each end of the contact blades is provided with a shielding wall, the accelerating effect is duplicated. The quick opening of the switch contacts provides an important advantage in that is saves the contact blades from erosive effects of the arc, whereby the lifetime of the switch is prolonged.

It will be obvious to a person skilled in the art that, as the technology advances, the inventive concept can be implemented in various ways. The invention and its embodiments are not limited to the examples described above but may vary within the scope of the claims.

The invention claimed is:

1. A rotary switch assembly, comprising a rotary contact and a stationary contact, and a rotary actuator for rotating the rotary contact such as to connect with and disconnect from the stationary contact, the rotary contact comprises one or more pairs of elongated contact blades, each blade including a blade portion arranged to make contact with the stationary contact such that one pair of elongated contact blades and the stationary contact interlock when in contact, a lateral gap being disposed between the pair of elongated contact blades such that the stationary contact is disposed within the lateral gap between the pair of elongated contact blades when the pair of elongated contact blades and the stationary contact interlock, and the rotary actuator is arranged to house the one or more pairs of elongated contact blades, wherein the rotary actuator comprises a shield that shields the blade portions from the stationary contact when the rotary contact and the stationary contact are being disconnected from each other.

2. A rotary switch assembly according to claim 1 wherein the shield is arranged to shield the rotary contact completely from the side facing the stationary contact between the rotary actuator and the blade portions of the rotary contact.

3. A rotary switch assembly according to claim 1 wherein the shield is formed as an integral part of a unitary rotary actuator.

4. A rotary switch assembly according to claim 1 wherein the shield is removably attachable to the rotary actuator.

5. A rotary switch assembly according to claim 1 wherein the rotary actuator comprises a body portion for receiving the rotary contact through the body portion such that portions of the rotary contact reside outside and on opposite sides of the body portion when the rotary contact is mounted to the rotary actuator.

6. A rotary switch assembly according to claim 1 wherein the rotary actuator comprises a substantially cylindrical body portion, and the shield extends from the cylindrical body portion.

7. A rotary switch assembly according to claim 1 wherein the rotary actuator comprises a first shield on one side of the rotary actuator, and a second shield on the opposite side of the rotary actuator.

8. A rotary switch assembly according to claim 1 wherein the first shield and the second shield residing on opposite sides of the rotary actuator are arranged to shield opposite sides of the rotary contact.

9. A rotary switch assembly according to claim 1 wherein the rotary actuator comprises a receptacle for receiving the shield that shields the rotary contact.

10. A rotary switch assembly according to claim 1 wherein the rotary contact comprises one or more pairs of elongated contact blades, and the rotary actuator is arranged to house the one or more pairs of elongated contact blades, and the shield comprises a compartment for each pair of elongated contact blades, the compartment arranged to shield the pair of elongated contact blades also from the outer sides.

11. A rotary switch assembly according to claim 1 wherein the shield is fixed to the rotary actuator such that is follows the rotation of the rotary actuator.

12. A rotary switch assembly according to claim 1, wherein the shield is arranged to shield the rotary contact from the rotary actuator to a longitudinal end of the rotary contact;

wherein that the shield is arranged to shield the rotary contact completely from the side facing the stationary contact between the rotary actuator and the blade end; and wherein that the shield is formed as an integral part of a unitary rotary actuator.

13. A rotary switch assembly according to claim 1, wherein the shield is removably attachable to the rotary actuator;

wherein that the rotary actuator comprises a body portion for receiving the rotary contact through the body portion such that portions of the rotary contact reside outside and on opposite sides of the body portion when the rotary contact is mounted to the rotary actuator; and wherein that the rotary actuator comprises a substantially cylindrical body portion, and the shield extends from the cylindrical body portion.

14. A rotary switch assembly according to claim 1, wherein the rotary actuator comprises a first shield on one side of the rotary actuator, and a second shield on the opposite side of the rotary actuator;

wherein that the first shield and the second shield residing on opposite sides of the rotary actuator are arranged to shield opposite sides of the rotary contact; and wherein that the rotary actuator comprises a receptacle for receiving the shield that shields the rotary contact.

15. A rotary switch assembly according to claim 1, wherein the rotary contact comprises one or more pairs of elongated contact blades, and the rotary actuator is arranged to house the one or more pairs of elongated contact blades, and the shield comprises a compartment for each pair of elongated contact blades, the compartment arranged to shield the pair of contact elongated blades also from the outer sides; and wherein that the shield is fixed to the rotary actuator such that is follows the rotation of the rotary actuator.

16. A rotary switch assembly according to claim 1, wherein the rotary contact comprises one or more pairs of elongated contact blades, and the rotary actuator is arranged to house the one or more pairs of elongated contact blades, and the shield comprises a compartment for each pair of elongated contact blades, the compartment arranged to shield the pair of elongated contact blades also from the outer sides;

wherein that the shield is fixed to the rotary actuator such that is follows the rotation of the rotary actuator;

wherein that the rotary actuator comprises a first shield on one side of the rotary actuator, and a second shield on the opposite side of the rotary actuator;

wherein that the first shield and the second shield residing on opposite sides of the rotary actuator are arranged to shield opposite sides of the rotary contact; and wherein that the rotary actuator comprises a receptacle for receiving the shield that shields the rotary contact.

17. A rotary switch assembly according to claim 1 wherein the shield is arranged to shield the blade portions along a radial length extending from an outer end of each blade portion and along an entire length of the lateral gap, the shield extending along a side facing the stationary contact when the elongated contact blades and the stationary contact are disconnected from each other.

18. A shield for an electric switch, wherein the shield comprises an interior space for receiving at least a portion of a one or more pairs of elongated contact blades, each blade including a blade end arranged to make contact with a stationary contact such that one pair of elongated contact blades and the stationary contact interlock when in contact, the shield further comprises a mounting portion for mounting the shield to a rotary actuator for rotating a rotary contact, and a shielding portion that shields the one or more pairs of elongated contact blades receivable at least partly interior of the shield, wherein the shield is arranged to shield a portion of each blade end not structured to directly contact the stationary contact, the rotary contact comprises one or more pairs of elongated contact blades, each blade including a blade portion arranged to make contact with the stationary contact such that one pair of elongated contact blades and the stationary contact interlock when in contact, a lateral gap being disposed between the pair of elongated contact blades such that the stationary contact is disposed within the lateral gap between the pair of elongated contact blades when the pair of elongated contact blades and the stationary contact interlock.

19. A shield for an electric switch according to claim 18, wherein the shield is made of electrically insulating material.

* * * * *